US011884437B2

(12) United States Patent
Bowerman

(10) Patent No.: US 11,884,437 B2
(45) Date of Patent: Jan. 30, 2024

(54) PACKAGING MACHINE AND APPARATUS AND METHOD FOR FEEDING CUPS FOR PACKAGING

(71) Applicant: RENNCO LLC, Homer, MI (US)

(72) Inventor: Brian C. Bowerman, Quincy, MI (US)

(73) Assignee: RENNCO LLC, Homer, MI (US)

( * ) Notice: Subject to any disclaimer, the term of this patent is extended or adjusted under 35 U.S.C. 154(b) by 12 days.

(21) Appl. No.: 17/691,581

(22) Filed: Mar. 10, 2022

(65) Prior Publication Data

US 2023/0050201 A1 Feb. 16, 2023

Related U.S. Application Data

(60) Provisional application No. 63/231,290, filed on Aug. 10, 2021.

(51) Int. Cl.

| | |
|---|---|
| ***B65B 57/20*** | (2006.01) |
| ***B65B 35/32*** | (2006.01) |
| ***B65B 57/14*** | (2006.01) |
| ***B65B 5/06*** | (2006.01) |
| ***B65B 35/02*** | (2006.01) |
| ***B65B 35/50*** | (2006.01) |

(52) U.S. Cl.

CPC ..... *B65B 57/20* (2013.01); *B65B 5/06* (2013.01); *B65B 35/02* (2013.01); *B65B 35/32* (2013.01); *B65B 35/50* (2013.01); *B65B 57/14* (2013.01)

(58) Field of Classification Search

CPC ..... B65B 5/06; B65B 35/02; B65B 35/04; B65B 35/32; B65B 35/50; B65B 35/54; B65B 39/005; B65B 39/007; B65B 57/14; B65B 57/20; B65B 59/10; B65G 57/165; B65G 59/062; B65G 59/105; B65G 60/00; G07F 11/60

USPC ..... 53/248, 447, 498, 500, 531, 540; 221/133; 414/795.6, 788.2, 798.4

See application file for complete search history.

(56) References Cited

U.S. PATENT DOCUMENTS 2,646,898 A * 7/1953 Coon, Sr. et al. ..... B65B 35/54 414/789.6
2,649,952 A * 8/1953 Rapp ..... B65B 35/54 198/448
3,289,385 A 12/1966 Syverson et al.
(Continued)

FOREIGN PATENT DOCUMENTS

GB 2241695 A * 9/1991 ..... G07F 13/10
JP 03098915 A * 4/1991

*Primary Examiner* — Stephen F. Gerrity
(74) *Attorney, Agent, or Firm* — THOMPSON HINE LLP

(57) ABSTRACT

An apparatus for use in delivering cup-like containers to a container receiving path of a packaging station includes: a first infeed tower and a second infeed tower, each of the first infeed tower and the second infeed tower having: a stationary upper segment and a movable lower segment, wherein the movable lower segment is movable between a load position, in alignment with the stationary upper segment for receiving cup-like containers from the stationary upper segment, and an unload position, in alignment with the container receiving path for delivering cup-like containers to the container receiving path; a transfer gate controllable to block feed of cup-like containers from the stationary upper segment down into the movable lower segment; and an outlet gate controllable to block feed of cup-like containers down out of the movable lower segment.

18 Claims, 19 Drawing Sheets

(56) References Cited

U.S. PATENT DOCUMENTS

| | | | | |
|---|---|---|---|---|
| 3,313,482 | A | 4/1967 | Midgley et al. | |
| 3,497,086 | A | 2/1970 | Adams et al. | |
| 3,661,282 | A | 2/1972 | Buhayar et al. | |
| 3,780,885 | A | 12/1973 | Van Der Roer | |
| 3,791,537 | A | 2/1974 | Conklin | |
| 4,024,951 | A | 5/1977 | Green | |
| 4,142,345 | A | 3/1979 | Porter, Jr. | |
| 4,193,494 | A | 3/1980 | Green | |
| 4,545,714 | A | 10/1985 | Johnson et al. | |
| 4,555,891 | A | 12/1985 | Sauerbruch | |
| 4,796,406 | A * | 1/1989 | Gies et al. | B65B 43/145 414/795.8 |
| 4,921,398 | A | 5/1990 | Fluck | |
| 4,927,319 | A | 5/1990 | Montali | |
| 5,095,684 | A | 3/1992 | Walker et al. | |
| 5,122,029 | A | 6/1992 | DelDuca | |
| 5,163,073 | A | 11/1992 | Chasteen et al. | |
| 5,222,861 | A | 6/1993 | Focke et al. | |
| 5,410,859 | A | 5/1995 | Kresak et al. | |
| 5,555,706 | A | 9/1996 | Maoloni et al. | |
| 5,704,194 | A | 1/1998 | Niehaus | |
| 5,809,751 | A | 9/1998 | Braibanti | |
| 6,241,457 | B1 | 6/2001 | Huttig et al. | |
| 6,267,550 | B1 | 7/2001 | Morgan | |
| 6,397,567 | B1 | 6/2002 | Focke et al. | |
| 6,425,227 | B1 | 7/2002 | Salm et al. | |
| 6,699,006 | B2 | 3/2004 | Schlimgen et al. | |
| 6,804,934 | B1 * | 10/2004 | Bianchi | B65B 5/06 53/411 |
| 6,851,920 | B2 | 2/2005 | Trautwein et al. | |
| 7,269,934 | B2 | 9/2007 | Cremers et al. | |
| 7,478,511 | B2 | 1/2009 | Thurgood | |
| 7,762,467 | B2 | 7/2010 | Thurgood | |
| 2005/0263952 | A1 | 12/2005 | Campioli et al. | |
| 2006/0131130 | A1 | 6/2006 | Thurgood et al. | |

* cited by examiner

PACKAGING MACHINE AND APPARATUS AND METHOD FOR FEEDING CUPS FOR PACKAGING

TECHNICAL FIELD

The present application relates to packaging machines and more particularly to a packaging machine for delivering cups or like containers to a packaging station.

BACKGROUND

Cups are typically packaged for retail or commercial sale as nested stacks of cups within a plastic bag for retail sale, for example, in a grocery store, supermarket, gas station, etc. Improvements in the handling of cups and cup-like containers for packaging are desirable.

SUMMARY

In one aspect, an apparatus for use in delivering cup-like containers to a container receiving path of a packaging station includes an infeed tower having: an upper tower segment; a lower tower segment; an upper inlet end for receiving cup-like containers into the upper tower segment; a lower outlet end for selectively feeding the cup-like containers from the lower tower segment to the container receiving path; wherein the upper tower segment includes a lower transfer end and the lower tower segment includes an upper transfer end; wherein the lower tower segment is movable between a load position and an unload position; wherein, in the load position of the lower tower segment, the upper transfer end of the lower tower segment aligns with the lower transfer end of the upper tower segment for receiving cup-like containers from the upper tower segment, and the lower outlet end is offset from the container receiving path; wherein, in the unload position of the lower tower segment, the lower tower segment is moved out of alignment with the upper tower segment so as to position the lower outlet end over the container receiving path.

In another aspect, an apparatus for use in delivering cup-like containers to a container receiving path of a packaging station includes: a first infeed tower and a second infeed tower, each of the first infeed tower and the second infeed tower having: a stationary upper segment and a movable lower segment, wherein the movable lower segment is movable between a load position, in alignment with the stationary upper segment for receiving cup-like containers from the stationary upper segment, and an unload position, in alignment with the container receiving path for delivering cup-like containers to the container receiving path; a transfer gate controllable to block feed of cup-like containers from the stationary upper segment down into the movable lower segment; and an outlet gate controllable to block feed of cup-like containers down out of the movable lower segment.

In a further aspect, a method of delivering cup-like containers to a container receiving path of a packaging station, involves: (a) utilizing a first infeed tower with a first movable tower segment and a second infeed tower with a second movable tower segment; (b) loading cup-like containers into the first movable tower segment while the first movable tower segment is in a first load position offset from the container receiving path (c) loading cup-like containers into the second movable tower segment while the second movable tower segment is in a second load position offset from the container receiving path; (d) shifting the first movable tower segment to an unload position aligned with the container receiving path and dropping cup-like containers from the first movable tower segment to the container receiving path; (e) shifting the first movable tower segment back toward the first load position; and (f) shifting the second movable tower segment to the unload position and dropping cup-like containers from the second movable tower segment to the container receiving path.

The details of one or more embodiments are set forth in the accompanying drawings and the description below. Other features, objects, and advantages will be apparent from the description and drawings, and from the claims.

DETAILED DESCRIPTION

Figure 1:
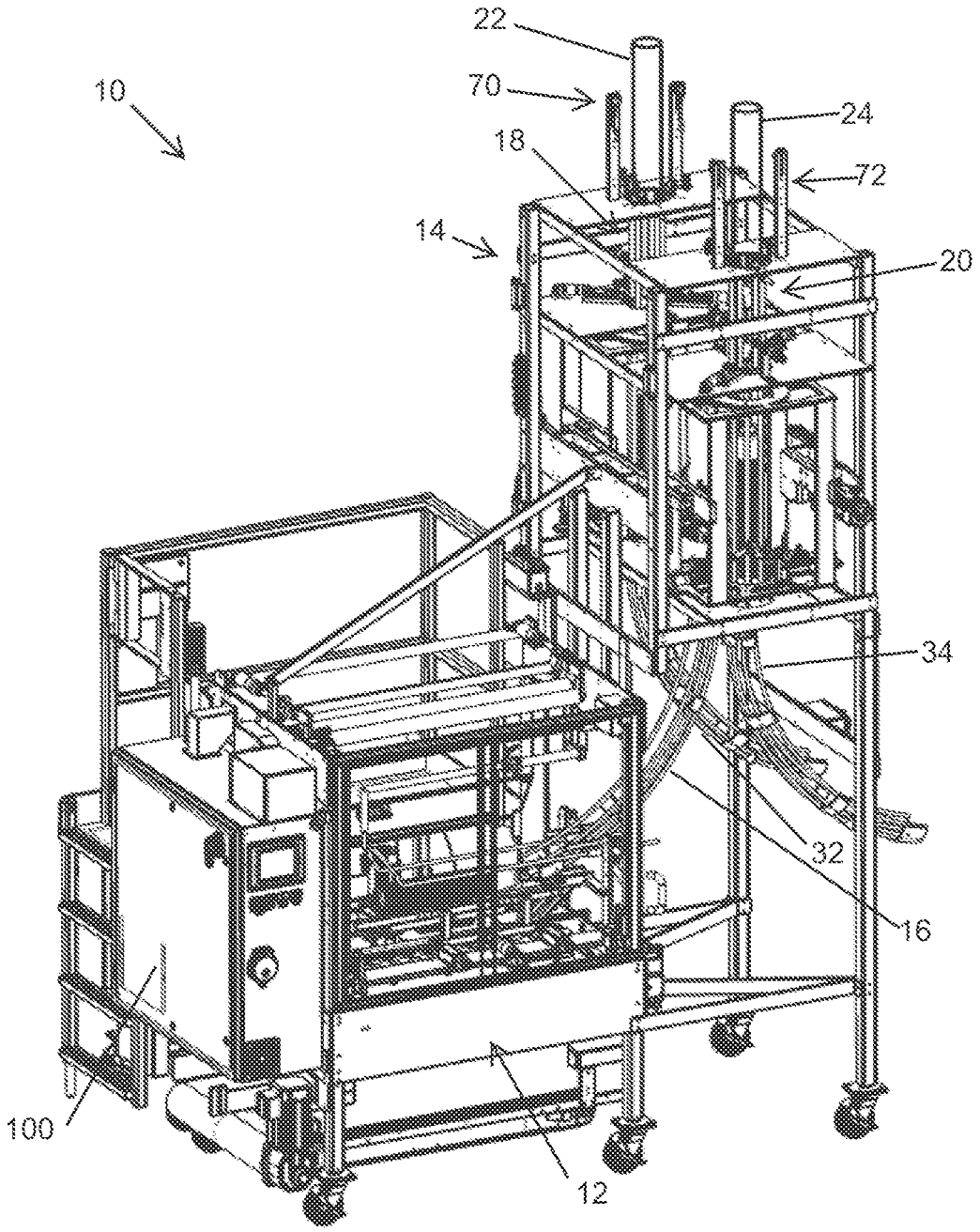
FIG. 1 is a perspective view of a packaging system including a packaging section and a cup infeed section.
Figure 2:
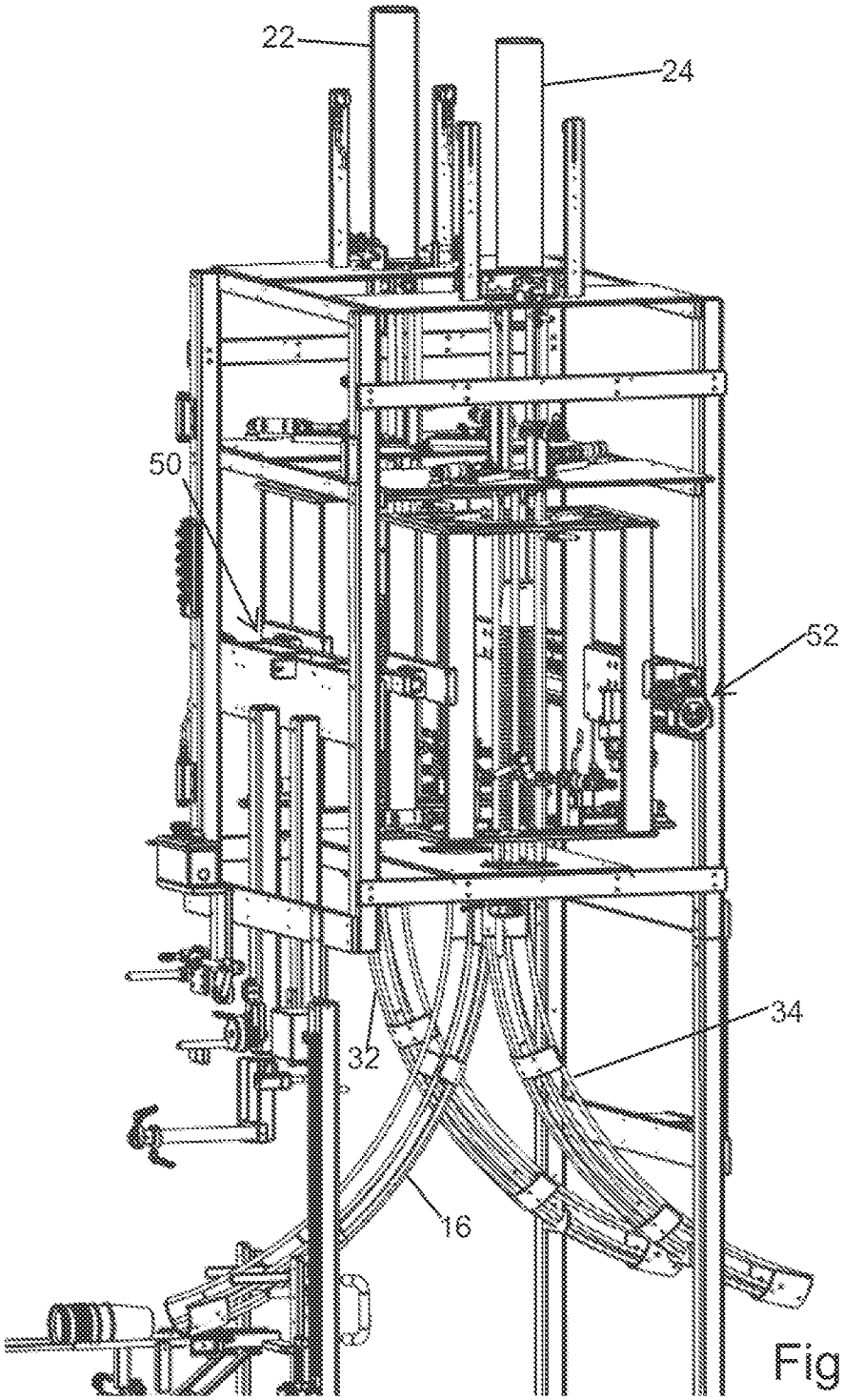
FIG. 2 is a partial perspective view of the cup infeed section.
Figure 3:
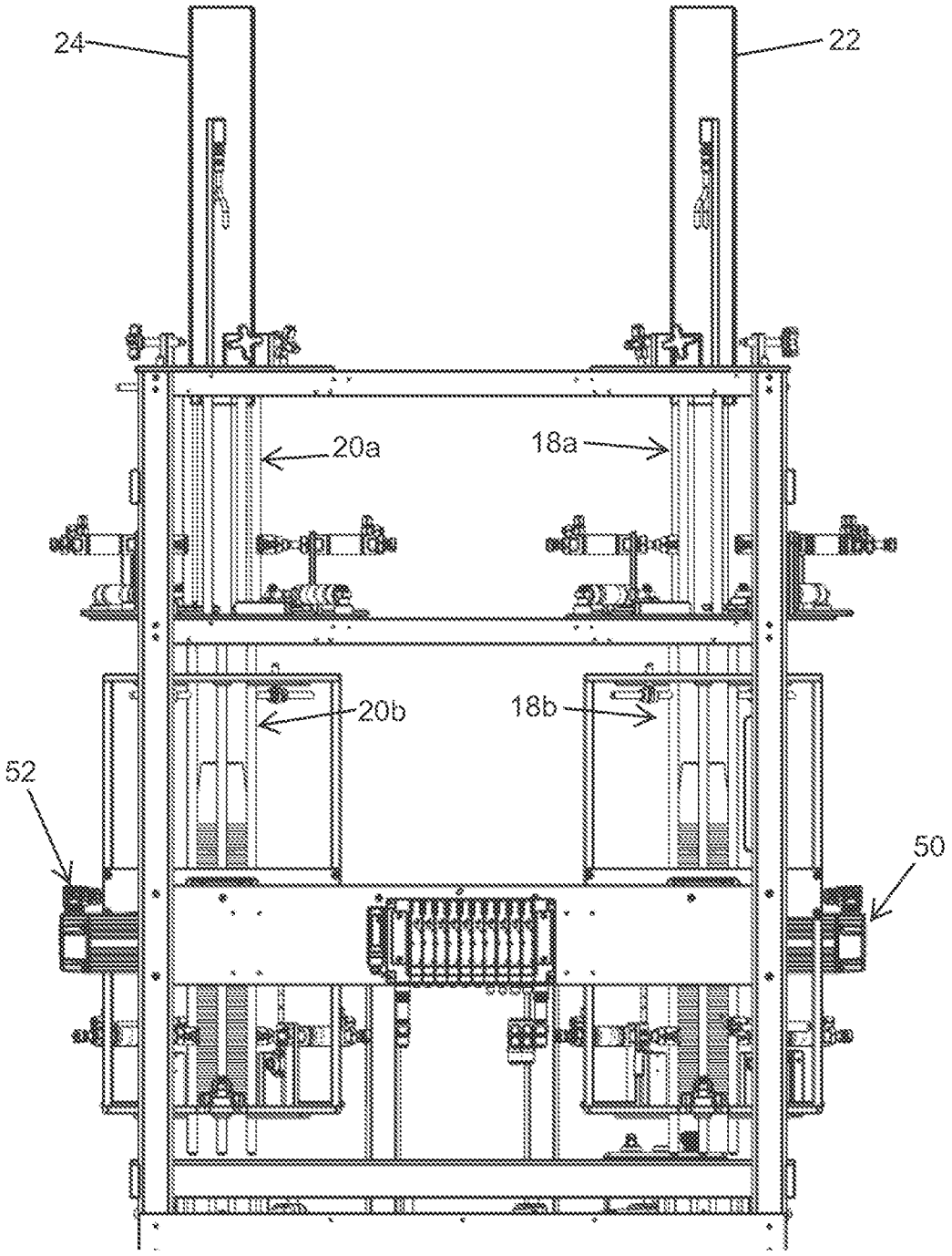
FIG. 3 is an elevation view of part of the cup infeed section, from a side opposite the packaging section.
Figure 4:
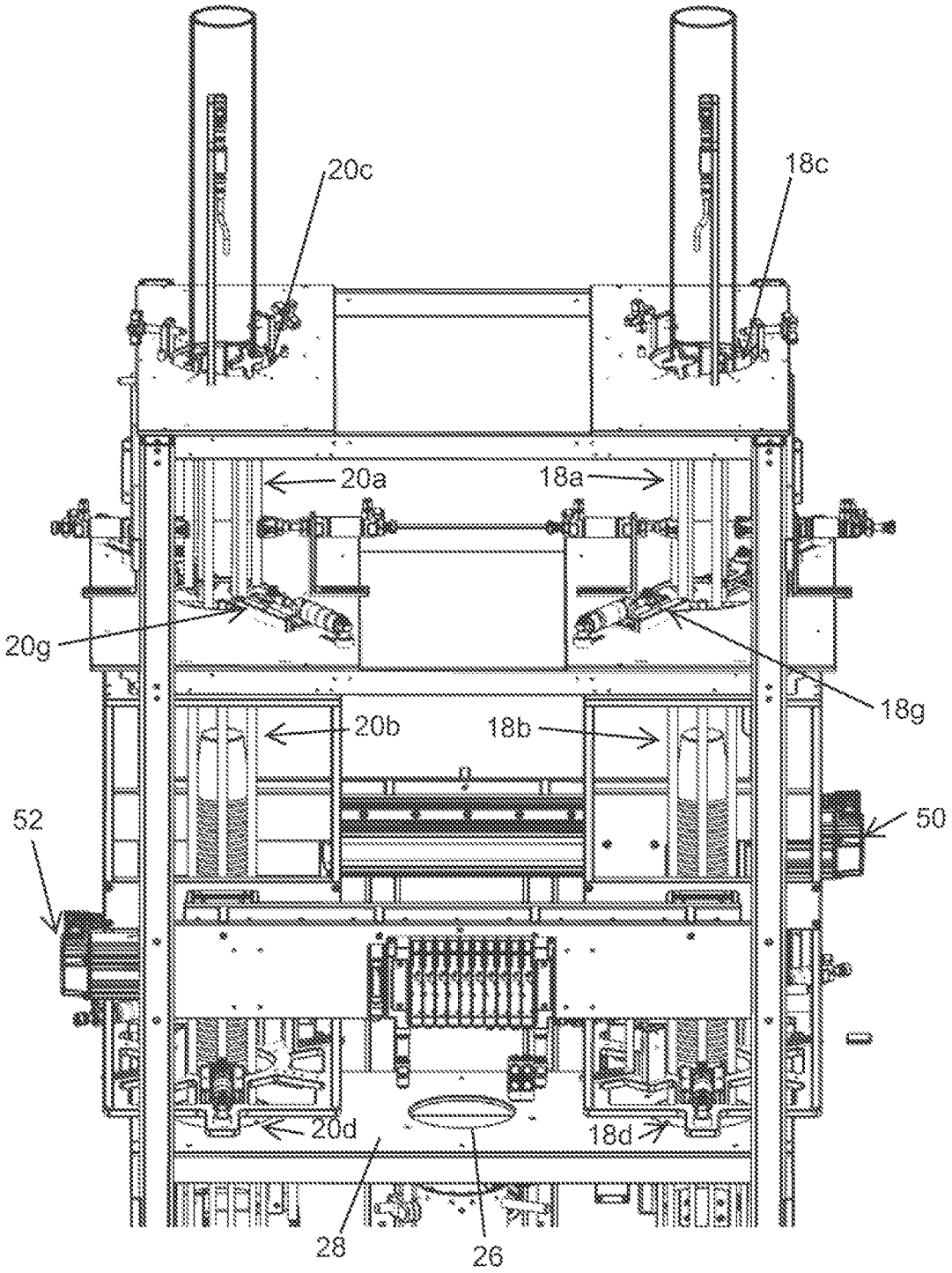
FIG. 4 is a perspective view of FIG. 3.
Figure 5:
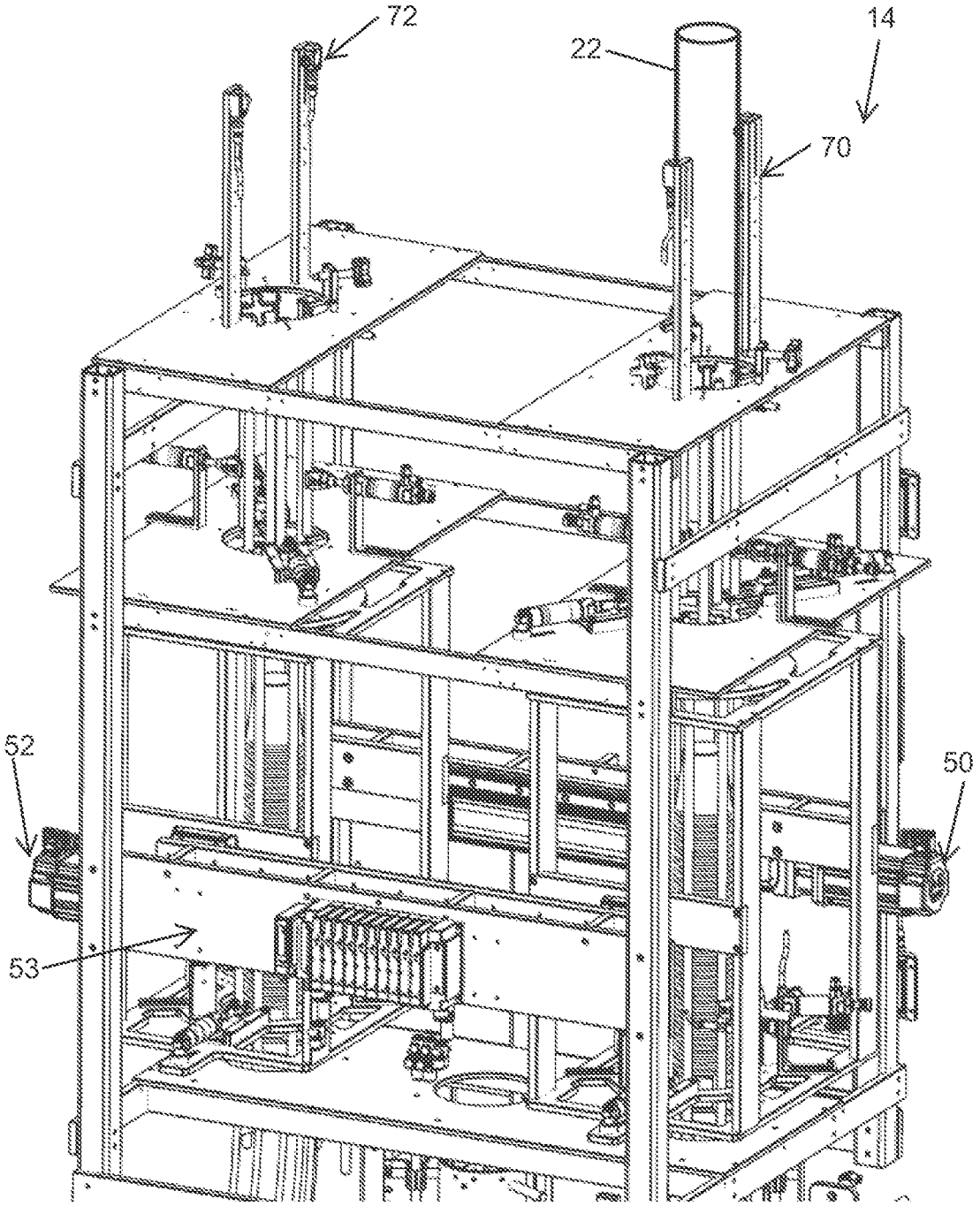
FIGS. 5 and 6 are other perspective views of the cup infeed section from a side opposite the packaging section.
Figure 6:
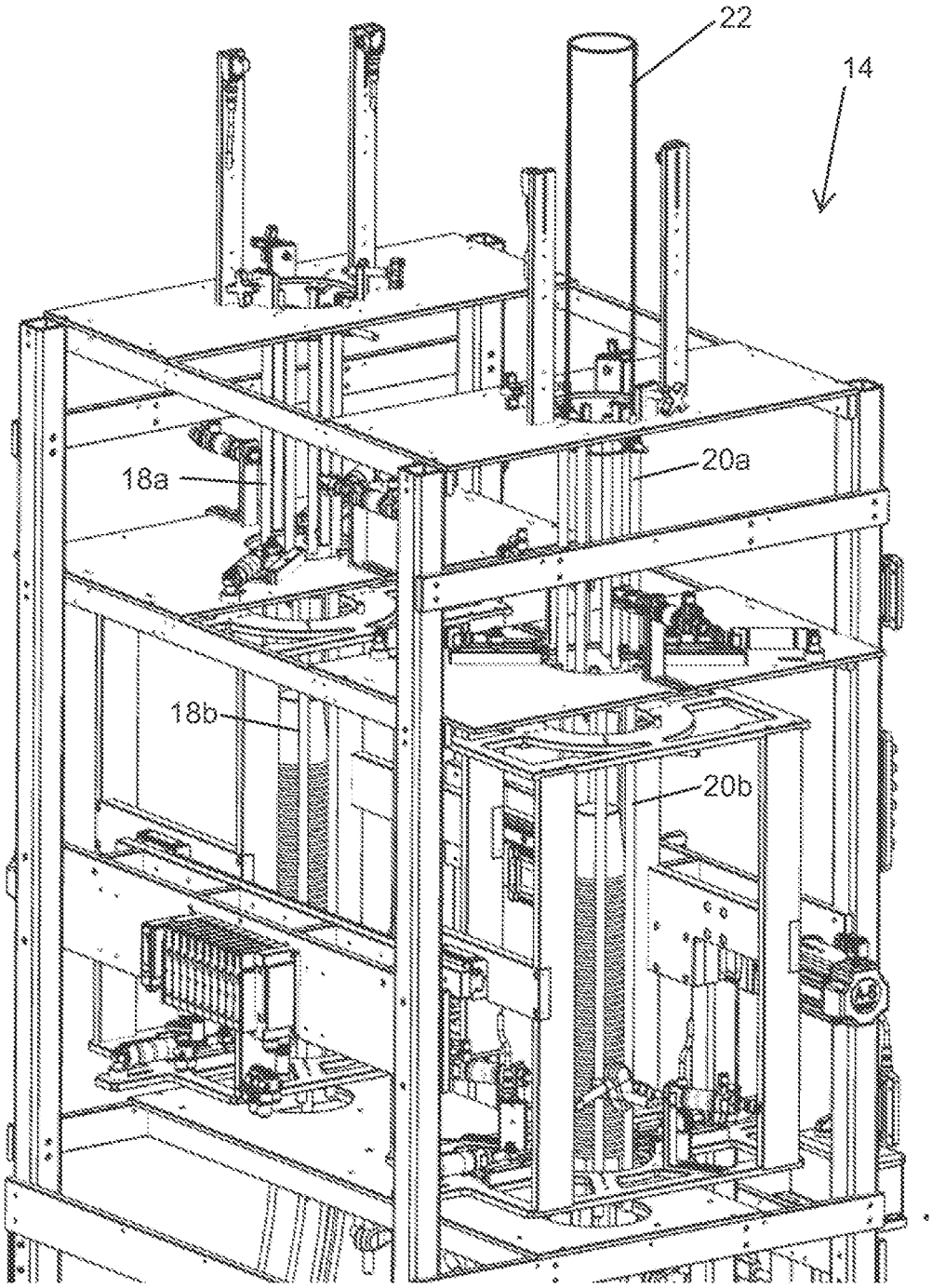
Figure 7:
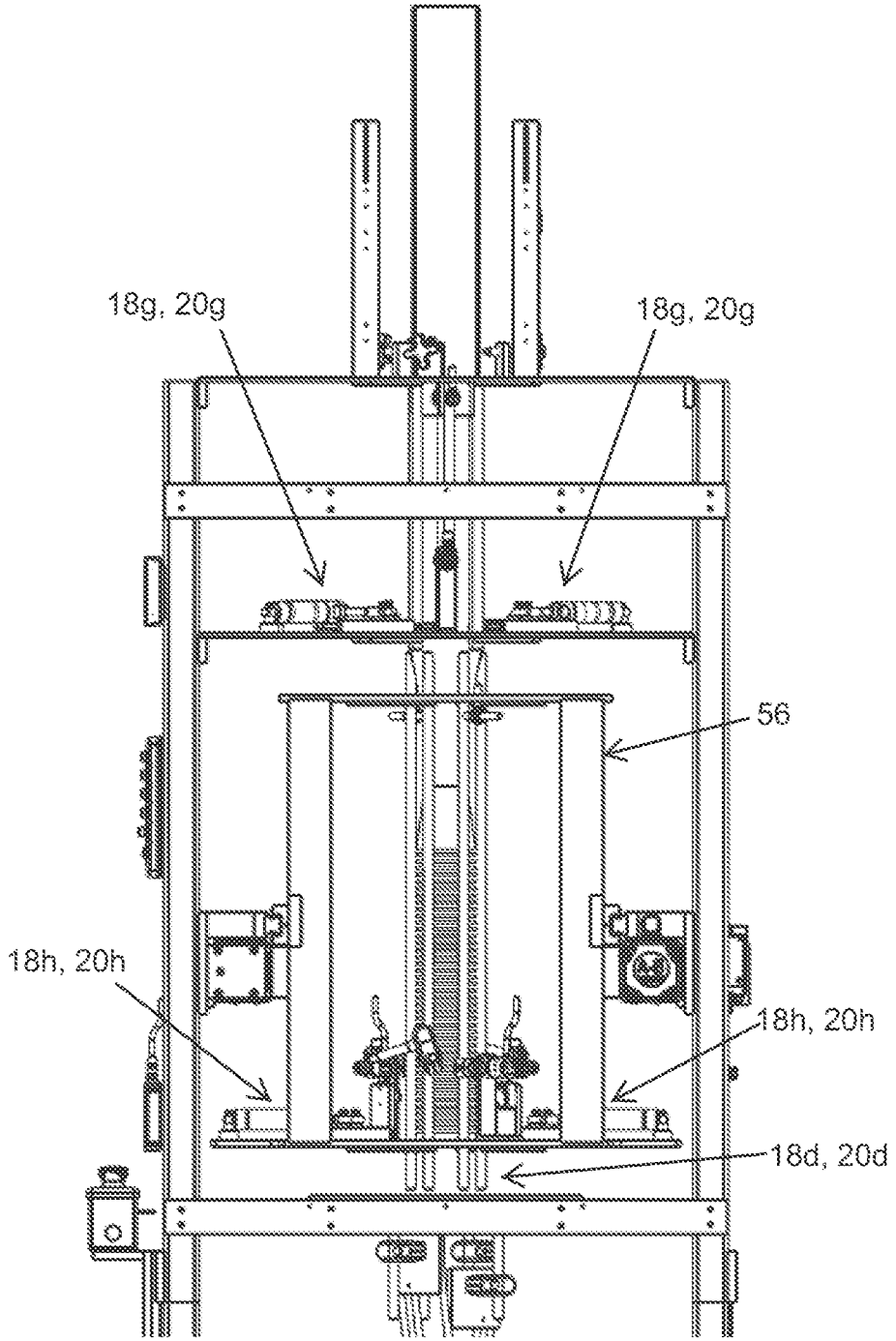
FIG. 7 is a partial side elevation of the cup infeed section.
Figure 8:
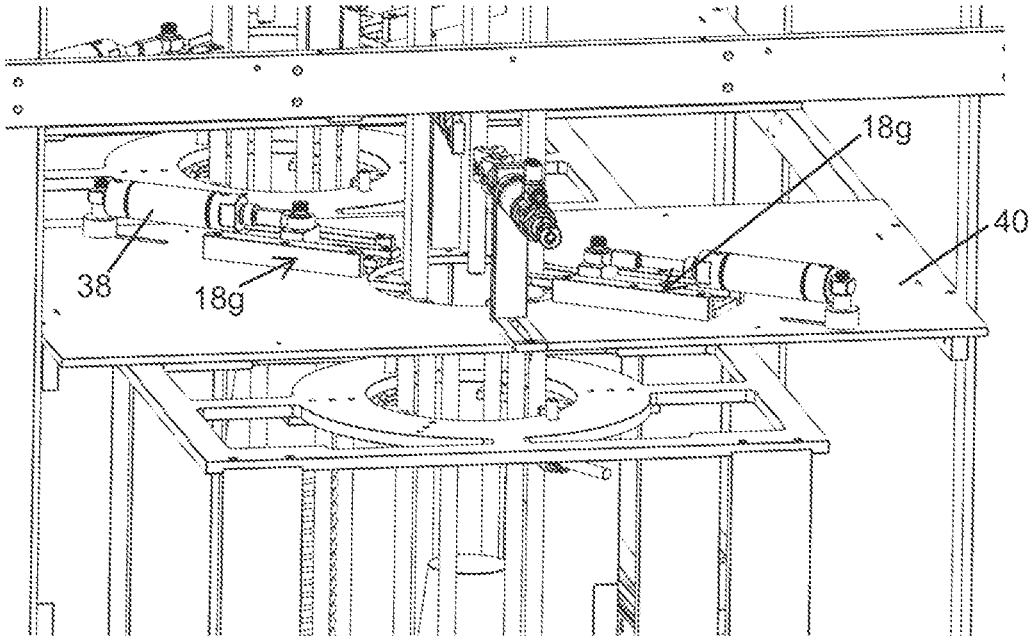
FIGS. 8 and 9 are perspective views of a transfer gate arrangement.
Figure 9:
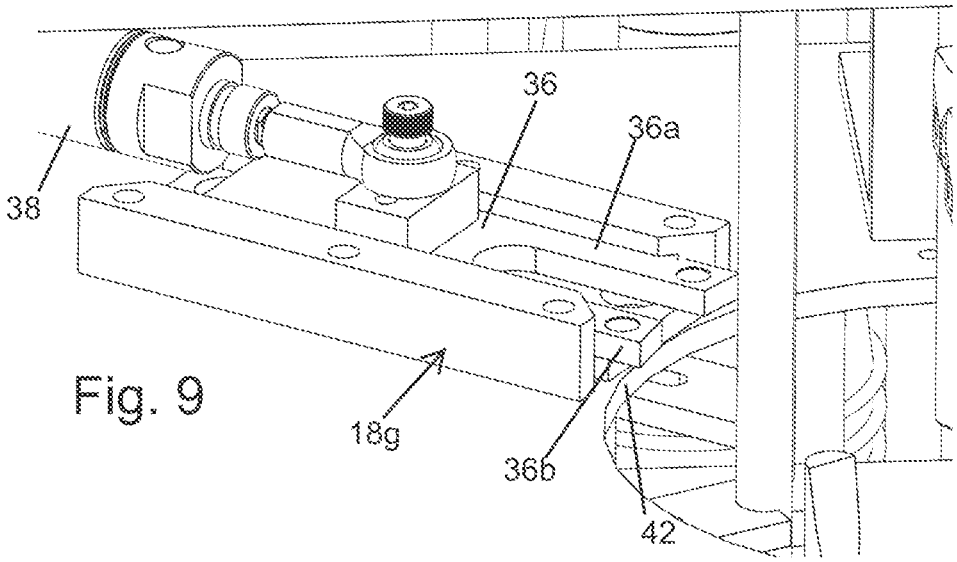
Figure 10:
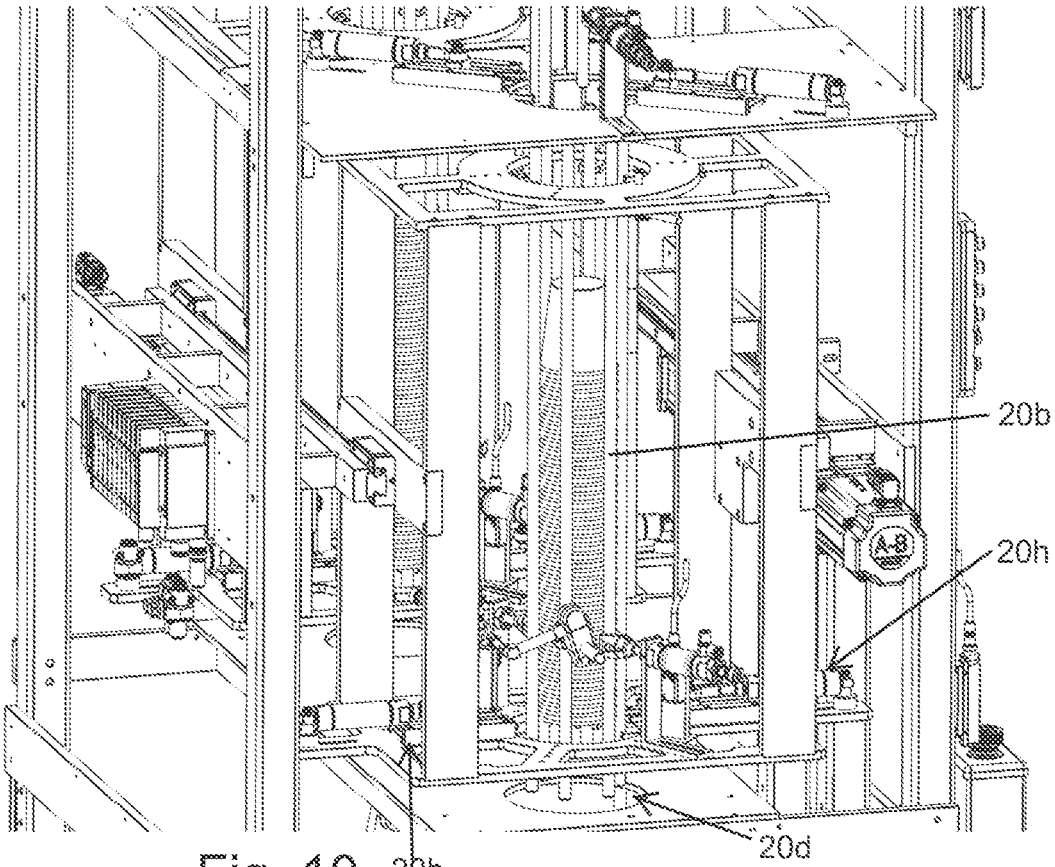
FIGS. 10 and 11 are perspective views of the lower portion of an infeed tower.
Figure 11:
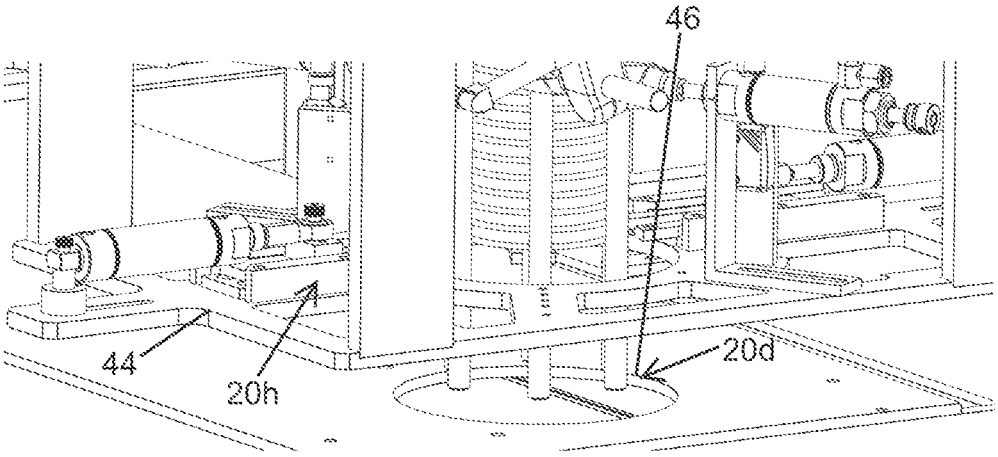
Figure 12:
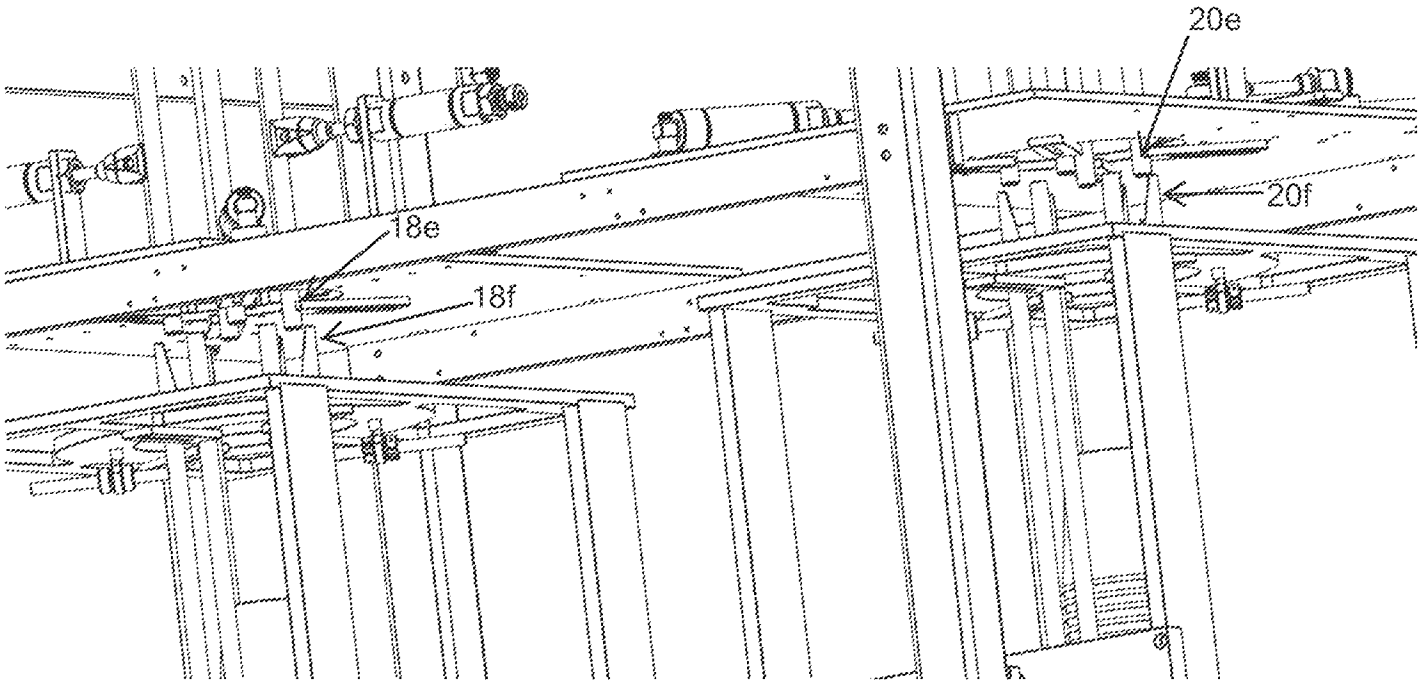
FIG. 12 is a perspective view of lower tower segments in alignment with upper tower segments.
Figure 13:
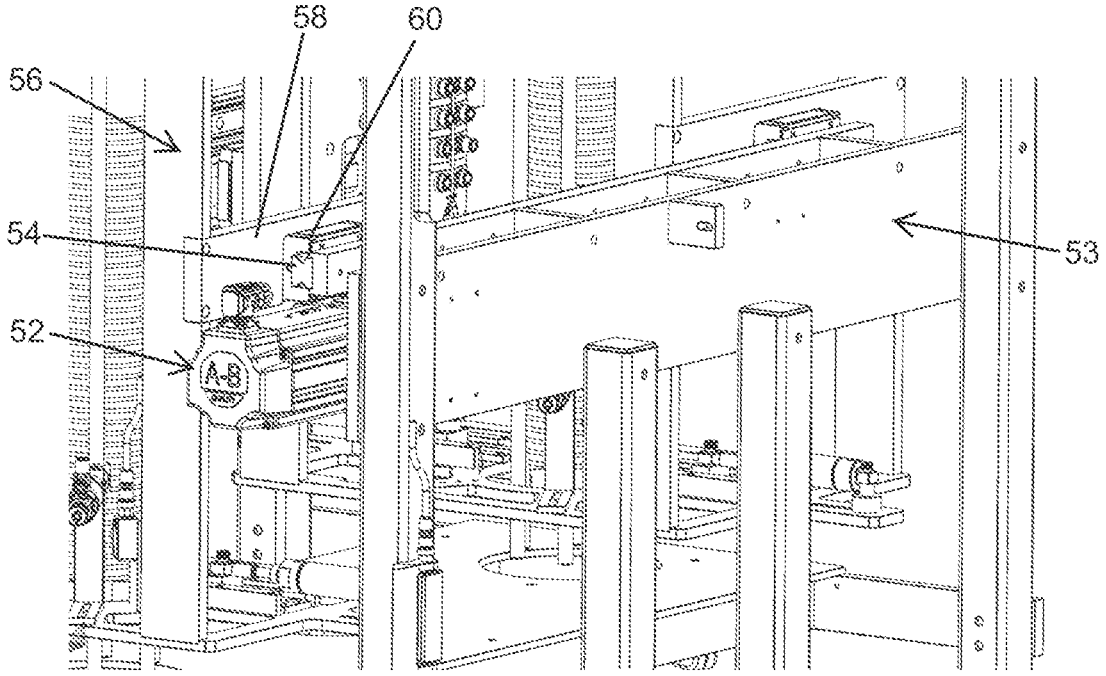
FIGS. 13-16 are perspective views of a servo drive arrangement with portions cut away or removed for additional clarity.
Figure 14:
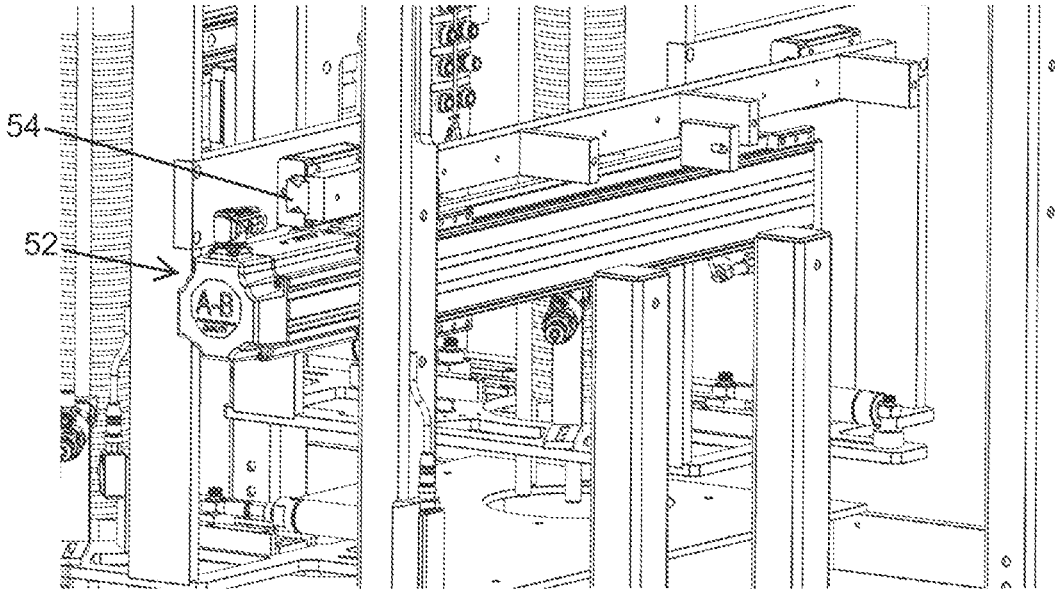
Figure 15:
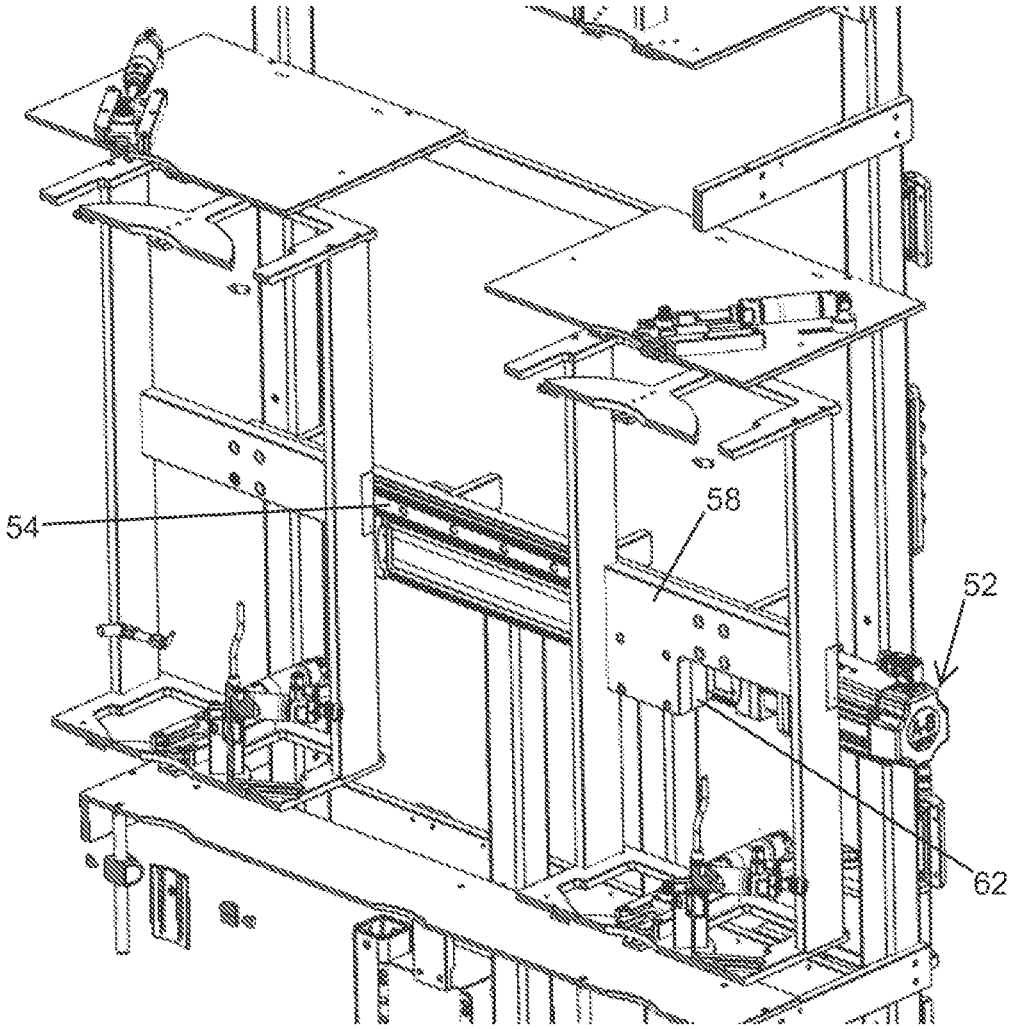
Figure 16:
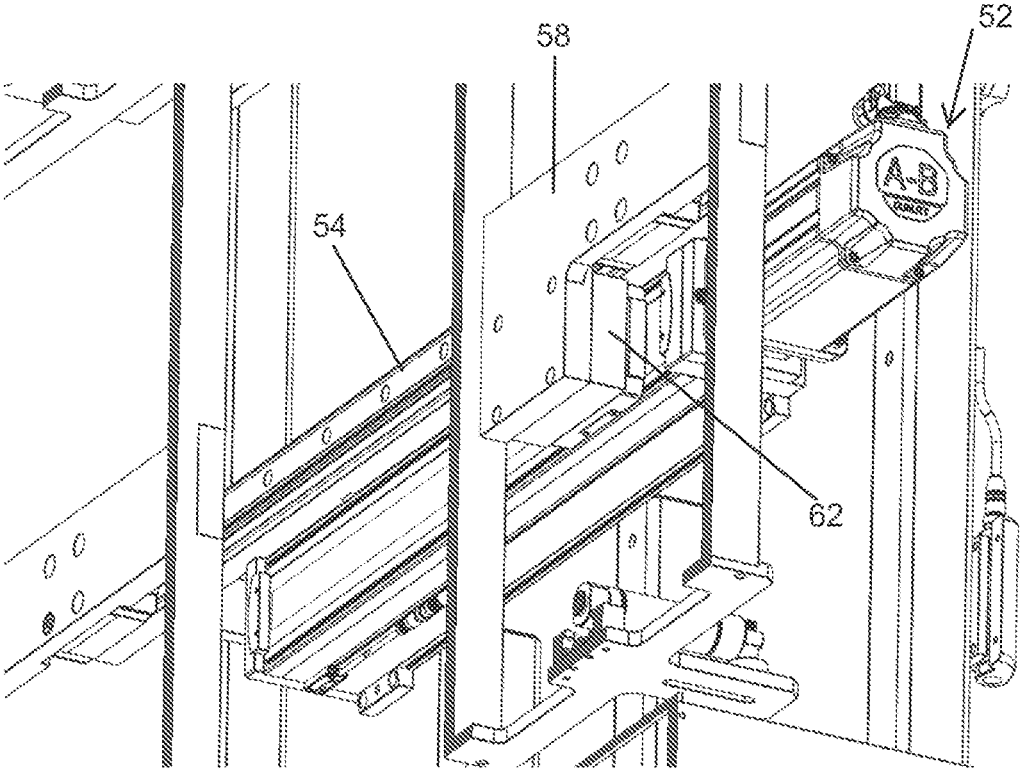

Referring to FIGS. 1-17, a Referring to FIG. 1, packaging system 10 is shown and includes a packaging section 12 and a cup feed section 14. The packaging section 12 may, by example, be formed by a bagging machine that places nested cups into bags, such as a Rennco vertical L bar sealer that forms and seals a bag around a group or groups of nested cups. However, other type of packaging sections are also possible. Notably, a container receiving path 16 (e.g., formed as a curved slide path defined by a set of rods) leads from the cup feed section 14 to the packaging section 12. Here, one path is shown, but embodiments with more than one path are possible.

The cup feed section 14 includes a pair of infeed towers 18 and 20, each of which may include a respective infeed tube 22, 24 to the infeed tower. Cups may typically be delivered into the infeed tubes 22, 24 by an upstream forming press coupled with pneumatic tubing to act as the path of conveyance. Each infeed tower 18, 20 includes an upper tower segment 18*a*, 20*a* and a lower tower segment 18*b*, 20*b*. An upper inlet end 18*c*, 20*c*, at the top of the upper tower segment, provides an inlet opening for receiving cups into the upper tower segment, and a lower outlet end 18*d*, 20*d*, at the bottom of the lower tower segment, provides an outlet opening for selectively feeding cups down out of the lower tower segment. Here, each tower segment is formed by a set of generally parallel bars that surround a path along with cups can drop, but other configurations are possible. Here, each infeed tower runs substantially vertically. However, embodiments in which the infeed towers are offset from vertical (e.g., at an angle of sixty degrees or more relative to horizontal) are possible.

Each upper tower segment 18*a*, 20*a* includes a respective lower transfer end 18*e*, 20*e* and each lower tower segment 18*b*, 20*b* includes a respective upper transfer end 18*f*, 20*f*. Each lower tower segment is movable between a load position (e.g., shown in FIGS. 3-4), in alignment with its upper tower segment, and an unload position (shown schematically in FIGS. 18B & 18D), located over an inlet opening 26 (e.g., in a fixed plate 28) to the container receiving path 16 of the packaging section. In the load position of each lower tower segment, the upper transfer end 18*f*, 20*f* of the lower tower segment aligns with the lower transfer end 18*e*, 20*f* of the upper tower segment (per FIG. 12) for receiving cup-like containers from the upper tower segment, and the lower outlet end 18*d*, 20*d* is offset from the container receiving path 16 (per FIG. 4). In this regard, in the load position, each lower outlet end is aligned with a respective plate opening 29, 30 that leads to a respective bypass path 32, 34. The bypass paths 32, 34 can be used to empty the infeed towers of cups without delivering the cups to the bagging section, if necessary (e.g., during maintenance or a changeover etc.).

Each infeed tower 18, 20 includes an upper transfer gate or gates 18*g*, 20*g* located proximate the lower transfer end of the upper tower segment. Here, two diametrically opposed gates are used. The upper transfer gates have an open position (e.g., FIGS. 8 and 9) for allowing cups to pass down out of the upper tower segment and into the lower tower segment (when aligned). Here, each transfer gate is formed by a U-shaped bracket 36 with fingers 36*a*, 36*b* that are movable into the path of the upper tower segment to achieve the closed position to block further passage of cups. A linear actuator 38 (e.g., solenoid, pneumatic or motor controlled) provides position control for the gate. Each transfer gate is mounted on a fixed plate (e.g., 40) proximate the lower end of the upper tower segment, where the plate includes an opening (e.g., 42) through which cups pass to reach the lower tower segment.

Each infeed tower 18, 20 also includes a lower outlet gate or gates 18*h*, 20*h* located proximate the lower outlet end of the lower tower segment. The lower outlet gates may be of similar configuration to the transfer gates 18*g*, 20*g*, having a closed position for retaining cup-like containers in the lower tower segment and an open position for allowing cup-like containers to pass down out of the lower tower segment. Here, each lower outlet gate 18*h*, 20*h* is mounted on a plate (e.g., 44) that actually moves with the lower tower segment, where the plate has an opening (e.g., 46) through which cups pass to pass downward out of the lower tower segment and to the container receiving path 16 or the bypass path 32, 34, depending upon the position of the lower tower segment when the lower outlet gate 18*h*, 20*h* is opened.

Each lower tower segment 18*b*, 20*b* is movable by a respective servo linear drive 50, 52. In this regard, and referring only to drive 52 by way of example, the drive is mounted on a drive frame 53 that operates as a shuttle. The interior side of the drive frame carries a slide rail 54. The lower tower segment is mounted to a box frame structure 56 that includes a mount plate 58 facing the slide rail 54. An upper portion of the mount plate 58 carries a slide channel 60 that is slidingly engaged onto the slide rail 54, and a lower portion of the mount plate 58 is linked to the movable side portion of the drive 52 via a connecting block 62. Thus, movement of the drive causes sliding movement of the box frame structure 56 and lower tower segment along the rail between the desired load and unload positions.

Figure 17:
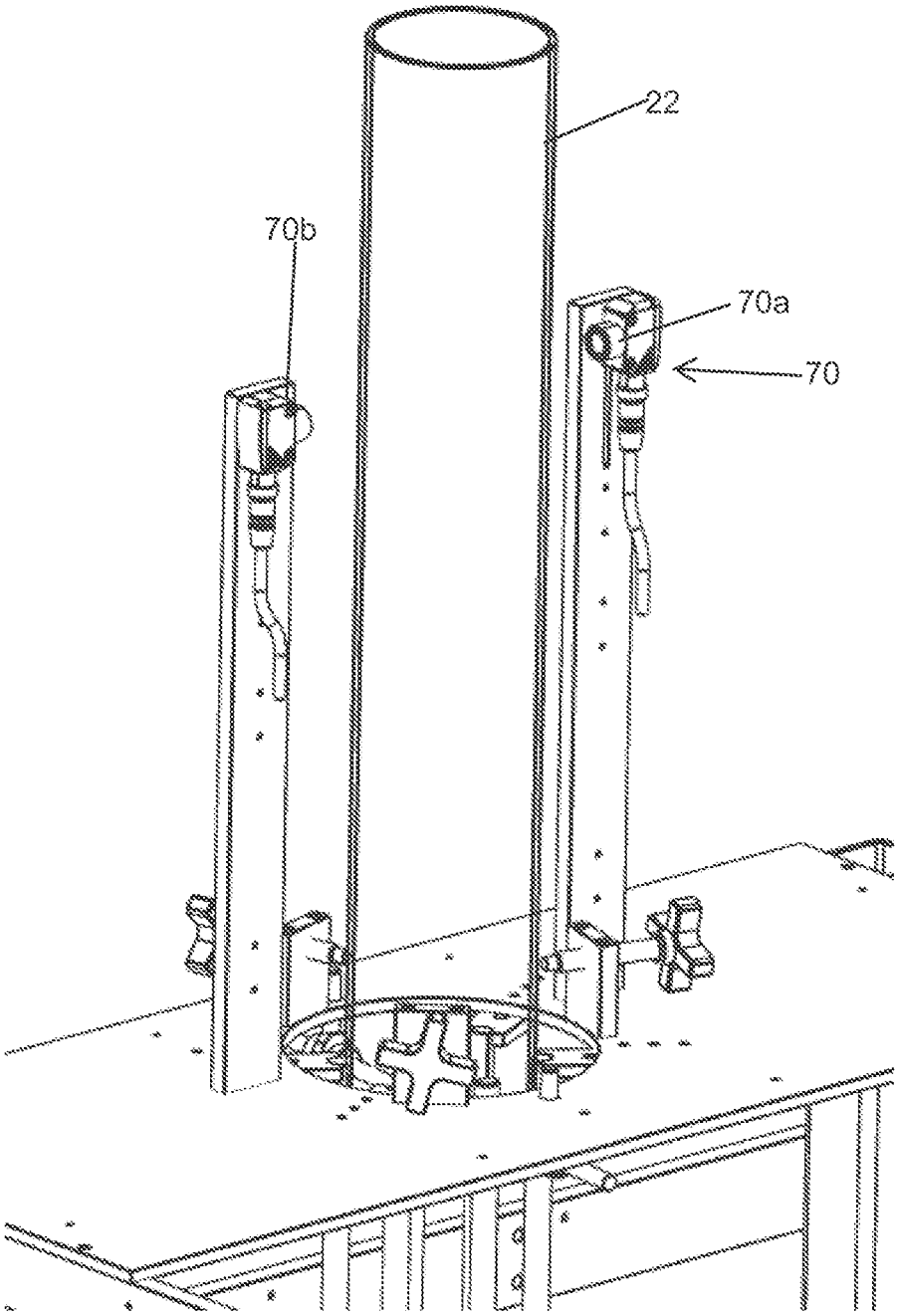
FIG. 17 is a perspective view of a cup sensor arrangement.

A controller 100 is provided for control of the drives and the gates. Here, the controller 100 controls both the packaging section 12 and the cup feed section 14. As used herein, the term controller is intended to broadly encompass any circuit (e.g., solid state, application specific integrated circuit (ASIC), an electronic circuit, a combinational logic circuit, a field programmable gate array (FPGA)), processor (s) (e.g., shared, dedicated, or group—including hardware or software that executes code), software, firmware and/or other components, or a combination of some or all of the above, that carries out the control and/or processing functions of the device or the control and/or processing functions of any component thereof. In addition, each feed tower 18, 20 includes a respective cup sensor arrangement 70, 72. Referring to FIG. 17 and sensor arrangement 70 by way of example, the arrangement includes an optical emitter 70*a* and detector 70*b* arranged across the path through infeed tube 22, where the infeed tube is transmissive of the sensor light (e.g., the tube is clear or substantially clear plastic). As cups pass down through the tube 22 the optical connection between the emitter and detector is broken. The controller 100 is connected with the sensor arrangement and is configured to count the cups as they pass, so as to track the number of cups in each tower. More specifically, the controller can maintain a count of the number of cups in each lower tower segment and a number of cups retained in the upper tower segment (based upon the state of the transfer gate between the two tower segments).

Figure 18A:
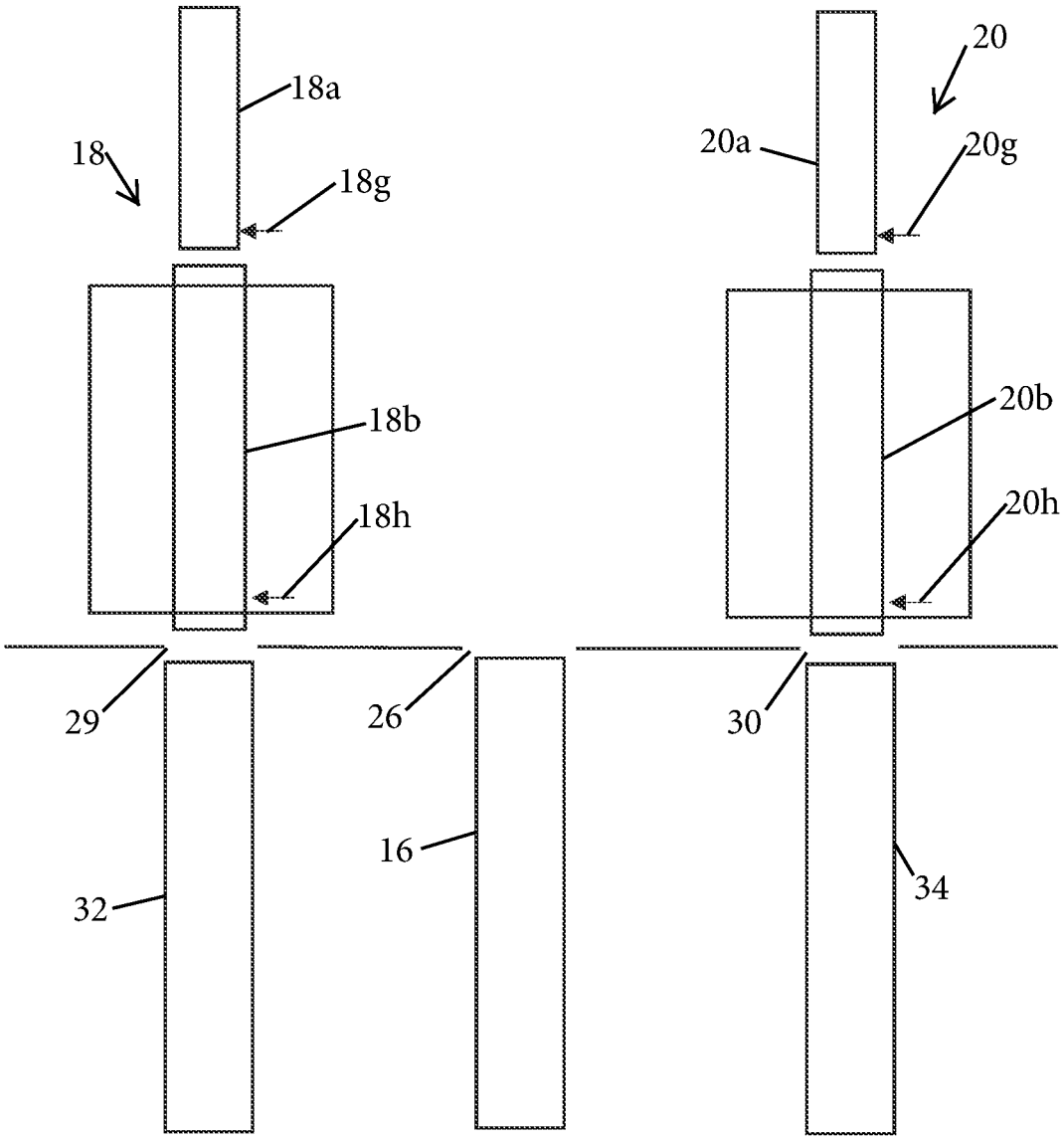
FIGS. 18A-18E schematically show exemplary movement of lower tower segments during operation.
Figure 18B:
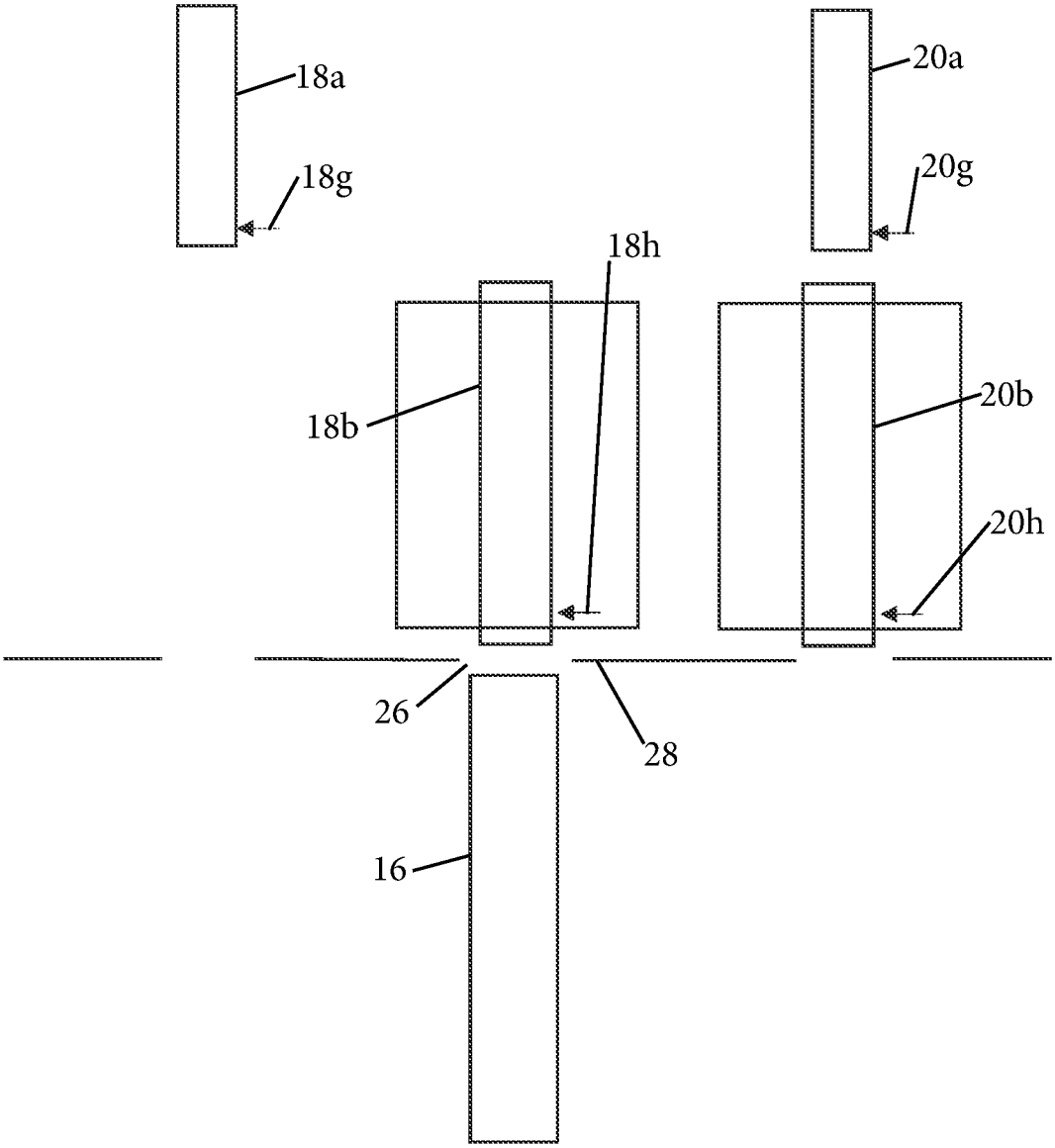
Figure 18C:
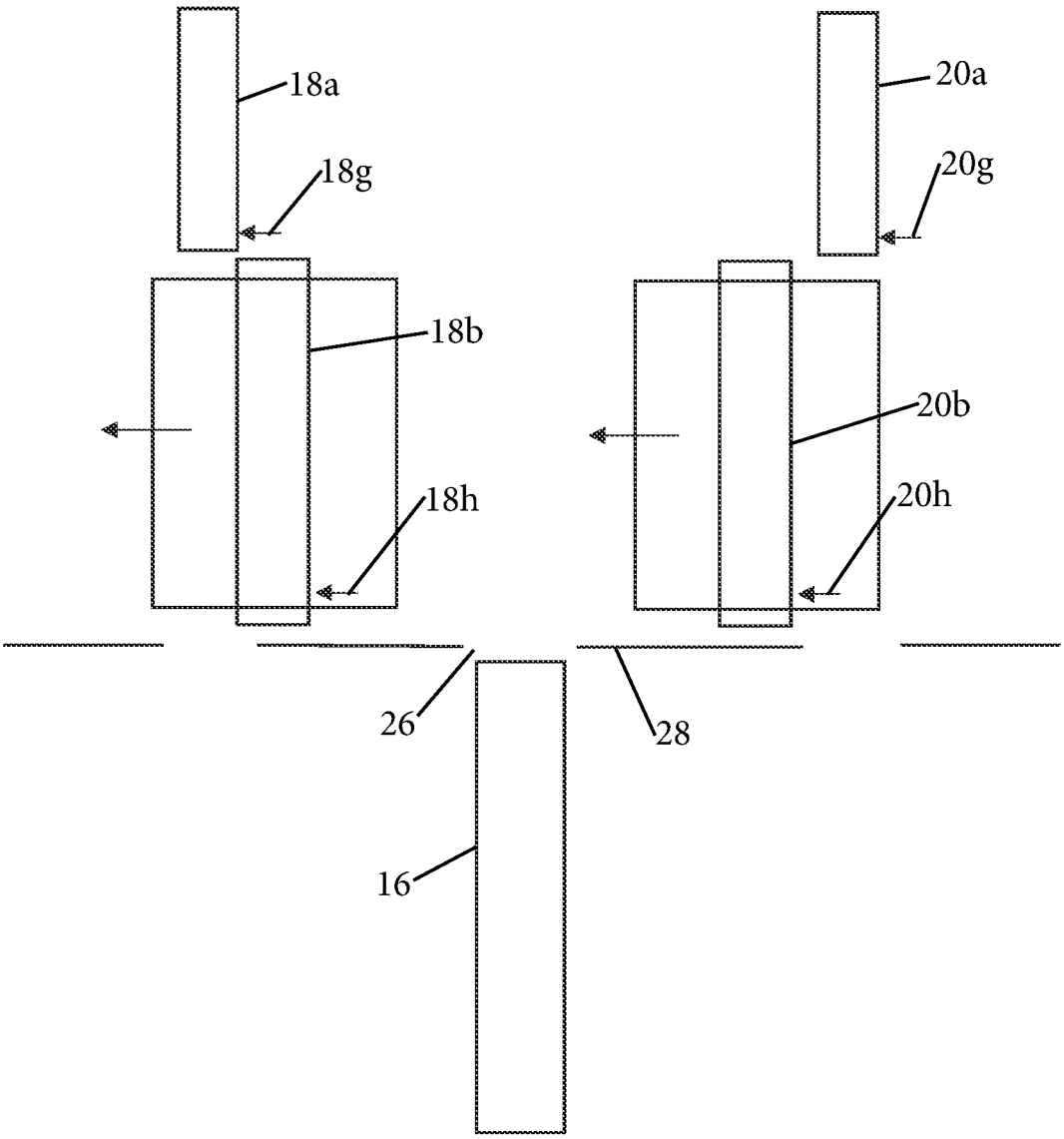
Figure 18D:
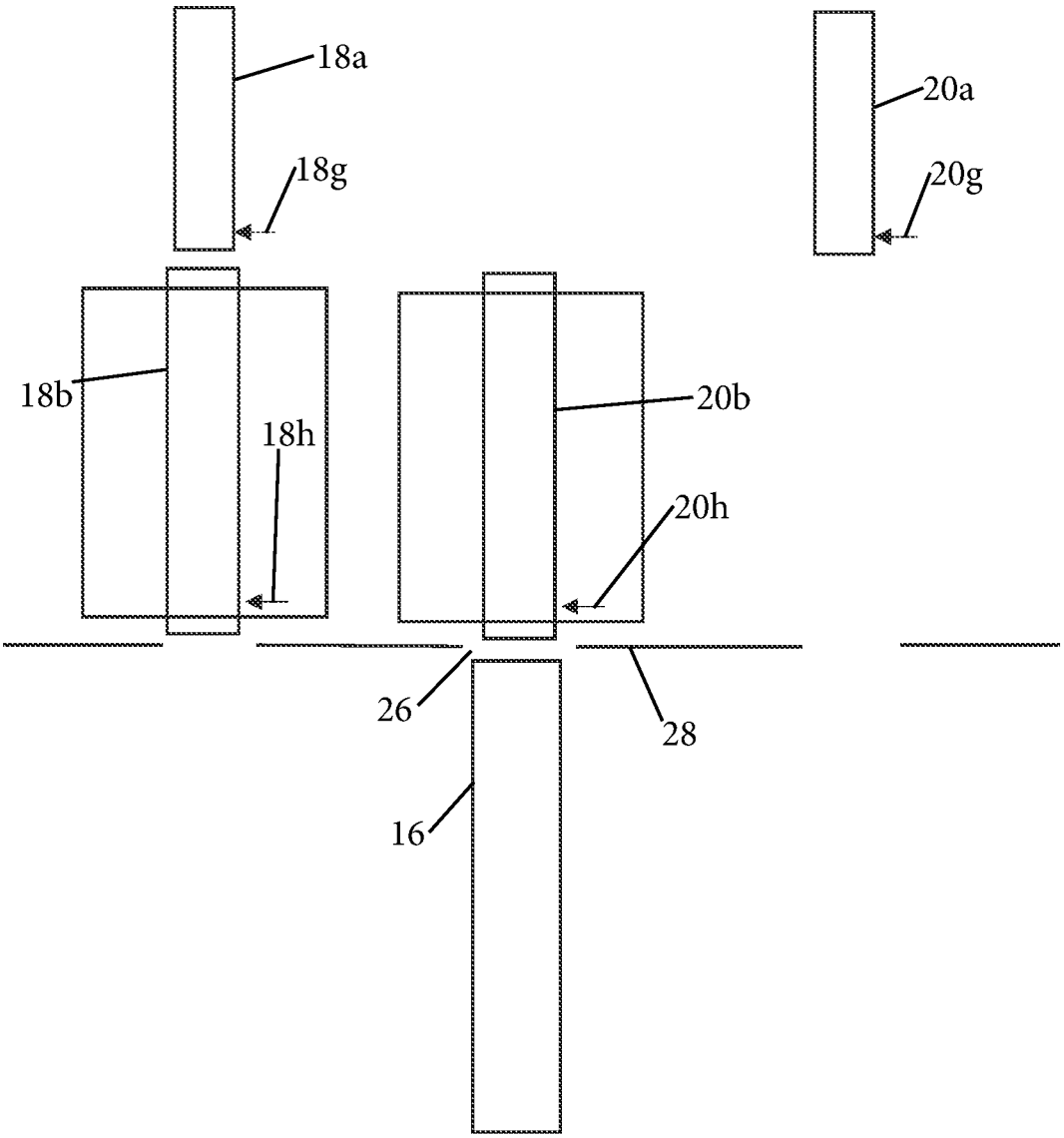
Figure 18E:
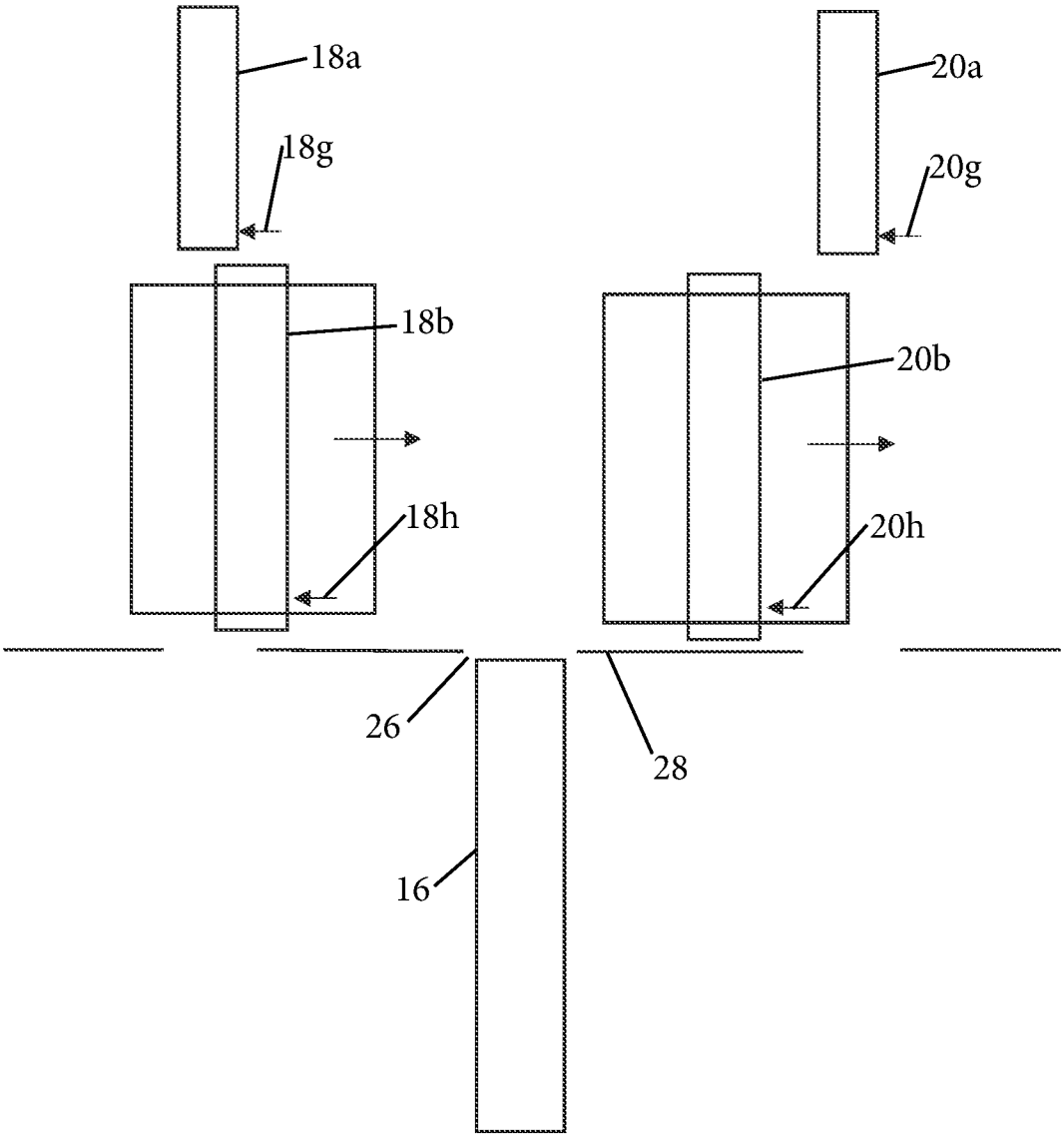

Thus, the controller 100, the sensor arrangements 70, 72 and the drives 50, 52 form a control system that can count cups and deliver specific cup counts to the container receiving path 16 as needed. An exemplary operation of the cup infeed section 14 is shown schematically in FIGS. 18A-18E. FIG. 18A shows each infeed tower 18, 20 with its lower tower segment 18*b*, 20*b* in the load position, in alignment with the upper tower segment 18*a*, 20*a* to receive cups. As cups move down through each tower segment, the transfer gates 18*g*, 20*g* are open and the outlet gates 18*h*, 20*h* are closed. The cups are counted, and once a predefined count is reached in the lower tower segment 18*b*, 20*b*, the transfer gate 18*g*, 20*g* is closed so that further incoming cups will be retained in the upper tower segment, with a separate count maintained for the cups in the upper tower segment 18*a*. With the predefined cup count attained in the lower tower segment 18*b*, the lower tower segment 18*b* is shifted (via the servo drive) to the unload position shown in FIG. 18B, into alignment with the container receiving path 16, at which point the outlet gate 18*h* is opened, allowing the cups to move down into the container receiving path 16. The lower tower segment 18*b* can then be shifted back toward the load position, per FIG. 18C, and the lower tower segment 20*b* can begin shifting toward the unload position (assuming the predefined cup count has been attained in the lower tower segment 20*b* and the transfer gate 20*g* closed). When the lower tower segment 18*b* again reaches its load position, per FIG. 18D, and with the outlet gate 18*h* now closed, the transfer gate 18*g* is opened so that any cups in the upper tower segment 18*a* move down into the lower tower segment 18*b*, and the cup count for the lower tower segment adjusted accordingly (e.g., based upon the known number of cups that were in the upper tower segment 18*a*). In addition, when the lower tower segment 20*b* reaches the unload position, per FIG. 18D, the outlet gate 20*h* is opened to allow the cups in the lower tower segment 20*b* to move down into the container receiving path 26. Per FIG. 18E, the lower tower segment 20*b* can then begin shifting back toward its load position and the lower tower segment 18*b* toward the unload position. Thus, a sequence of alternating delivery of predefined cup counts from each of the lower tower segments 18*b*, 20*b* to the container receiving path 26 is achieved. However, such an alternating sequence, while desirable for speed, is not required.

It is to be clearly understood that the above description is intended by way of illustration and example only, is not intended to be taken by way of limitation, and that other changes and modifications are possible. Although cups are primarily referred to above, it is understood that other containers of a similar nature could be handled in the same way. As used herein, the term "cup-like containers" refers to both cups and other nestable containers with a closed end and an open end, such as tubs or bowls.

What is claimed is:

1. An apparatus for use in delivering cup-like containers to a container receiving path of a packaging station, the apparatus comprising:

an infeed tower having:

an upper tower segment, a lower tower segment, an upper inlet end for receiving cup-like containers into the upper tower segment, a lower outlet end for selectively feeding cup-like containers from the lower tower segment to the container receiving path, wherein the upper tower segment includes a lower transfer end and the lower tower segment includes an upper transfer end, wherein the lower tower segment is movable between a load position and an unload position, wherein, in the load position of the lower tower segment, the upper transfer end of the lower tower segment aligns with the lower transfer end of the upper tower segment for receiving cup-like containers from the upper tower segment, and the lower outlet end is offset from the container receiving path, wherein, in the unload position of the lower tower segment, the lower tower segment is moved out of alignment with the upper tower segment so as to position the lower outlet end over the container receiving path;

an upper transfer gate having a closed position for retaining cup-like containers in the upper tower segment and an open position for allowing cup-like containers to pass down out of the upper tower segment;

a lower outlet gate having a closed position for retaining cup-like containers in the lower tower segment and an open position for allowing cup-like containers to pass down out of the lower tower segment;

wherein the lower outlet gate is connected for movement with the lower tower segment between the load position and the unload position.

2. The apparatus of claim 1, further comprising:

a control system for counting cup-like containers in the infeed tower and for selectively controlling the upper transfer gate, the lower transfer gate and movement of the lower tower segment between the load position and the release position.

3. The apparatus of claim 2, wherein control system includes a drive and the lower tower segment and the lower outlet gate are mounted on a shuttle that is movable via the drive.

4. The apparatus of claim 3, wherein the control system includes at least one sensor for detecting feed of cup-like containers into the upper tower segment and a controller operatively connected with the sensor, the drive, the upper transfer gate, the lower transfer gate, the controller configured for maintaining at least one container count.

5. The apparatus of claim 4, wherein the controller maintains a first container count of cup-like containers in the lower tower segment and a second container count of cup-like containers in the upper tower segment.

6. The apparatus of claim 4, wherein the container count comprises a count of cup-like containers in the lower tower segment, wherein the controller is configured such that, when the container count reaches a predefined count, (i) the upper transfer gate is closed, (ii) the lower tower segment is moved from the load position to the unload position and (iii) the lower outlet gate is opened to deliver cup-like containers from the lower tower segment to the container receiving path.

7. The apparatus of claim 6, wherein the controller is configured such that, subsequent to delivery of cup-like containers from the lower tower segment to the container receiving path, (i) the lower outlet gate is closed, (ii) the lower tower segment is moved from the unload position to the load position and (iii) the upper transfer gate is opened to allow more cup-like containers to enter the lower tower segment.

8. The apparatus of claim 1, wherein the infeed tower is a first infeed tower, the apparatus further comprising:

a second infeed tower having:

a second upper tower segment, a second lower tower segment, a second upper inlet end for receiving cup-like containers into the second upper tower segment, a second lower outlet end for selectively feeding cup-like containers from the second lower tower segment to the container receiving path, wherein the second upper tower segment includes a second lower transfer end and the second lower tower segment includes a second upper transfer end, wherein the second lower tower segment is movable between a second load position and a second unload position, wherein, in the second load position of the second lower tower segment, the second upper transfer end of the second lower tower segment aligns with the second lower transfer end of the second upper tower segment for receiving cup-like containers from the second upper tower segment, and the second lower outlet end is offset from the container receiving path, wherein, in the second unload position of the second lower tower segment, the second lower tower segment is moved out of alignment with the second upper tower segment so as to position the second lower outlet end over the container receiving path.

9. An apparatus for use in delivering cup-like containers to a container receiving path of a packaging station, the apparatus comprising:

an infeed tower having:

an upper tower segment, a lower tower segment, an upper inlet end for receiving cup-like containers into the upper tower segment, a lower outlet end for selectively feeding cup-like containers from the lower tower segment to the container receiving path, wherein the upper tower segment includes a lower transfer end and the lower tower segment includes an upper transfer end, wherein the lower tower segment is movable between a load position and an unload position, wherein, in the load position of the lower tower segment, the upper transfer end of the lower tower segment aligns with the lower transfer end of the upper tower segment for receiving cup-like containers from the upper tower segment, and the lower outlet end is offset from the container receiving path, wherein, in the unload position of the lower tower segment, the lower tower segment is moved out of alignment with the upper tower segment so as to position the lower outlet end over the container receiving path;

wherein, in the load position of the lower tower segment, the lower outlet end is aligned with a bypass secondary path to enable clearing of cup-like containers from the infeed tower without delivering cup-like containers to the container receiving path.

10. An apparatus for use in delivering cup-like containers to a container receiving path of a packaging station, the apparatus comprising:

a first infeed tower and a second infeed tower, each of the first infeed tower and the second infeed tower having, respectively:

a stationary upper segment and a movable lower segment, wherein the movable lower segment is movable between a load position, in alignment with the stationary upper segment for receiving cup-like containers from the stationary upper segment, and an unload position, in alignment with the container receiving path for delivering cup-like containers to the container receiving path;

a transfer gate controllable to block feed of cup-like containers from the stationary upper segment down into the movable lower segment;

an outlet gate controllable to block feed of cup-like containers down out of the movable lower segment;

a control system configured for controlling movement of the lower tower segment of the first infeed tower and the lower tower segment of the second infeed tower such that the lower tower segment of the first infeed tower and the lower tower segment of the second infeed tower are movable independently of each other.

11. The apparatus of claim 10, further comprising:

wherein the control system is configured for controlling the transfer gates, the outlet gates and movement of the movable lower segments such that, for each of the first infeed tower and the second infeed tower, (i) a defined count of cup-like containers is accumulated in the movable lower segment while the movable lower segment is in the load position, (ii) the movable lower segment is then moved to the unload position and cup-like containers of the movable lower segment are delivered to the container receiving path and (iii) the movable lower segment is then moved back to the load position.

12. The apparatus of claim 10, wherein the control system is configured such that the movable lower tower segment of the first infeed tower and the movable lower tower segment of the second infeed tower alternatingly deliver cup-like containers to the container receiving path.

13. The apparatus of claim 10, wherein the control system includes:

a first servo drive for moving the lower tower segment of the first infeed tower;

a second servo drive for moving the lower tower segment of the second infeed tower;

a first sensor for detecting feed of cup-like containers in the first infeed tower;

a second sensor for detecting feed of cup-like containers in the second infeed tower; and a controller operatively connected with the first sensor, the second sensor, the first servo drive and the second servo drive.

14. The apparatus of claim 13, wherein the controller is configured for maintaining at least a first container count corresponding to a number of cup-like containers in the lower tower segment of the first infeed tower and a second container count corresponding to a number of cup-like containers in the lower tower segment of the second infeed tower.

15. The apparatus of claim 14, wherein the controller is configured for maintaining a third container count corresponding to a number of cup-like containers in the upper tower segment of the first infeed tower and a fourth container count corresponding to a number of cup-like containers in the upper tower segment of the second infeed tower.

16. A packaging machine including a packaging section and the apparatus of claim 10, wherein the container receiving path feeds into the packaging section.

17. A method of delivering cup-like containers to a container receiving path of a packaging station, comprising:

(a) utilizing a first infeed tower with a first movable tower segment and a second infeed tower with a second movable tower segment, wherein the first movable tower segment and the second movable tower segment are movable independently of each other;

(b) loading cup-like containers into the first movable tower segment while the first movable tower segment is in a first load position offset from the container receiving path;

(c) loading cup-like containers into the second movable tower segment while the second movable tower segment is in a second load position offset from the container receiving path;

(d) shifting the first movable tower segment to an unload position aligned with the container receiving path and dropping cup-like containers from the first movable tower segment to the container receiving path;

(e) shifting the first movable tower segment back toward the first load position;

(f) shifting the second movable tower segment to the unload position and dropping cup-like containers from the second movable tower segment to the container receiving path.

18. The method of claim 17, wherein steps (b)-(f) are repeated in a manner such that the first movable tower segment and the second movable tower segment alternatingly drop cup-like containers to the container receiving path.

* * * * *